US011166620B2

(12) United States Patent
Racs et al.

(10) Patent No.: US 11,166,620 B2
(45) Date of Patent: Nov. 9, 2021

(54) DOMESTIC DISHWASHER

(71) Applicant: BSH Hausgeräte GmbH, Munich (DE)

(72) Inventors: Florian Racs, Heidenheim (DE); Thomas Steck, Holzheim (DE); Christoph Kapfer, Dillingen an der Donau (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 16/963,849

(22) PCT Filed: Mar. 6, 2019

(86) PCT No.: PCT/EP2019/055583
§ 371 (c)(1),
(2) Date: Jul. 22, 2020

(87) PCT Pub. No.: WO2019/170755
PCT Pub. Date: Sep. 12, 2019

(65) Prior Publication Data

US 2021/0038052 A1 Feb. 11, 2021

(30) Foreign Application Priority Data

Mar. 6, 2018 (DE) ..... 10 2018 203 288.2

(51) Int. Cl.
*A47B 88/04* (2006.01)
*A47L 15/50* (2006.01)
*A47B 88/487* (2017.01)

(52) U.S. Cl.
CPC ..... *A47L 15/507* (2013.01); *A47L 15/502* (2013.01); *A47B 88/487* (2017.01); *A47B 2210/0043* (2013.01); *A47B 2210/0059* (2013.01)

(58) Field of Classification Search
CPC .... A47L 15/507; A47L 15/502; A47B 88/487
See application file for complete search history.

(56) References Cited

U.S. PATENT DOCUMENTS 3,096,125 A * 7/1963 Kendt ..... F25D 25/024 384/19
3,466,109 A * 9/1969 Kauffman ..... A47L 15/504 312/228.1

(Continued)

FOREIGN PATENT DOCUMENTS

DE 2833824 A1 2/1980
DE 10122834 11/2002

(Continued)

OTHER PUBLICATIONS

National Search Report DE 10 2018 203 288.2 dated Dec. 11, 2018.
International Search Report PCT/EP2019/055583 dated May 14, 2019.

*Primary Examiner* — Kimberley S Wright
(74) *Attorney, Agent, or Firm* — Michael E. Tschupp; Andre Pallapies; Brandon G. Braun

(57) ABSTRACT

A household dishwasher includes a dishwasher cavity, and first and second rollers which are rotatably mounted in a roller holder that is fastened to the dishwasher cavity. A support element supporting a receptacle for items to be washed is movably mounted relative to the roller holder with the aid of the first roller and the second roller in such a way that the receptacle is movable between a position in which the receptacle is inserted into the dishwasher cavity and a position in which the receptacle is extracted from the dishwasher cavity. The support element has an upper running area and a lower running area, with the first roller being spaced apart downward from the upper running area and running along the lower running area, and with the second roller being spaced apart upward from the lower running area and running along the upper running area.

14 Claims, 6 Drawing Sheets

(56) References Cited

U.S. PATENT DOCUMENTS 3,829,191 A * 8/1974 Jenkins ..... A47B 88/437 312/228.1
3,851,943 A * 12/1974 Afful ..... A47L 15/507 312/228.1
3,982,802 A * 9/1976 Bailey ..... A47L 15/507 312/228.1
4,402,556 A * 9/1983 Schwind ..... F16C 13/006 384/281
4,535,524 A * 8/1985 Jenkins ..... A47B 88/487 29/453
4,595,247 A * 6/1986 Zank ..... A47B 88/487 312/334.19
5,242,222 A * 9/1993 Michael ..... A47B 88/57 16/95 R
5,345,959 A * 9/1994 Matteson ..... A47L 15/507 134/201
5,595,200 A * 1/1997 Favaro ..... A47L 15/504 134/201
6,619,772 B2 * 9/2003 Dierbeck ..... B25H 3/028 312/334.1
8,708,434 B2 * 4/2014 Oppel ..... A47L 15/507 312/228.1
10,022,038 B2 * 7/2018 Hansen ..... A47B 88/487
10,398,284 B2 * 9/2019 Hansen ..... A47L 15/507
2004/0256333 A1 * 12/2004 Buhlmeyer ..... A47L 15/507 211/41.9
2017/0122572 A1 5/2017 Dinkel
2018/0103828 A1 * 4/2018 Hansen ..... A47L 15/507
2018/0192852 A1 * 7/2018 Hansen ..... A47L 15/507

FOREIGN PATENT DOCUMENTS

DE 10163874 A1 7/2003
DE 102012016762 A1 3/2014
EP 1323372 A2 7/2003

* cited by examiner

DOMESTIC DISHWASHER

CROSS-REFERENCES TO RELATED APPLICATIONS

This application is the U.S. National Stage of International Application No. PCT/EP2019/055583, filed Mar. 6, 2019, which designated the United States and has been published as International Publication No. WO 2019/170755 A1 and which claims the priority of German Patent Application, Serial No. 10 2018 203 288.2, filed Mar. 6, 2018, pursuant to 35 U.S.C. 119(a)-(d).

BACKGROUND OF THE INVENTION

The present invention relates to a household dishwasher.

Household dishwashers are generally known with two roller holders attached on both sides of the dishwasher cavity and two rollers rotatably mounted thereto in each case. A respective C-shaped rail ("C-rail" in the following) runs on the rollers of a respective roller holder. On both sides, the two C-rails support a receptacle for items to be washed, for example a washing basket, in particular a dish rack or a cutlery drawer.

When the C-rail is moved (for the sake of better understanding, the explanations are based on only one C-rail) to extract or insert the receptacle for items to be washed, the rollers roll on their upper side over an upper running area of the C-rail. At the same time, however, the rollers perform a reverse movement on their lower side relative to a lower running area of the C-rail.

In the state of the C-rail in which it is not twisted in relation to its longitudinal axis, its lower running area and the upwardly bent sections of the C-shape connecting thereto on both sides have a spacing from the lower side of a respective roller or the side areas of the respective roller connecting to the lower side on both sides. The reverse movement mentioned above is harmless in this state.

It behaves differently, however, if the C-rail is twisted. This may occur, for example, if heavy items to be washed are situated in the receptacle for items to be washed in particular. The twisting of the C-rail leads to contact between the parts of roller and C-rail mentioned above which are moving in the reverse direction. This may lead to scratching and grinding noises. In any case, however, high friction forces have to be overcome when extracting or inserting the C-rail. This is detrimental to user friendliness.

BRIEF SUMMARY OF THE INVENTION

Against this background, an object of the present invention consists in creating an improved household dishwasher.

Accordingly, a household dishwasher with a dishwasher cavity and a first roller and a second roller and a roller holder is proposed, on which the first roller and the second roller are rotatably mounted and which is fastened to the dishwasher cavity. The household dishwasher has a support element for supporting a receptacle for items to be washed, which is mounted such that it can move relative to the roller holder with the aid of the first roller and the second roller in such a way that the receptacle for items to be washed can be moved between a position inserted into the dishwasher cavity and a position extracted from the dishwasher cavity. The support element has an upper running area and a lower running area. The first roller is spaced apart downward from the upper running area and runs along the lower running area. The second roller is spaced apart upward from the lower running area and runs along the upper running area.

The support element is therefore guided on its upper and lower running area by means of the second and first roller, respectively. In this context, the direction of movement of the upper running area and the rolling movement of the upper side of the second roller, and the direction of movement of the lower running area and the rolling movement of the lower side of the first roller, are aligned.

As a result of this guidance of the rail on upper and lower running areas, a twisting of the support element is prevented, or at least reduced. Additionally, this solution avoids a direct contact between parts moving in opposite directions and accordingly the development of high friction forces.

The first roller and the second roller are in particular arranged paraxially with regard to their axes of rotation.

The support element may also be referred to as rail or running rail.

The roller holder may also be referred to as supporting part.

A receptacle for items to be washed may involve a receptacle for wash items, in particular for dishes and/or cutlery. Preferably, the receptacle for items to be washed involves a dish rack or a cutlery drawer.

According to one embodiment, the support element is embodied in one piece.

Preferably, the upper and lower running area of the support element is embodied in one piece. The support element may in particular be extruded, together with the upper and lower running area.

According to a further embodiment, the support element is manufactured from metal.

The support element may for example be manufactured from metal or a metal alloy.

According to a further embodiment, the support element has a C-shaped profile.

In particular, the support element has a cross-section with a C-shaped profile. The C-shaped profile, for example, has a C-shaped section (for example a C-shaped element) and an opening (for example radial opening) between the free ends of the C-shaped section. C-shaped profiles can be advantageously manufactured by extrusion. The first roller and the second roller preferably run in the lower and upper indentation formed by the C-shaped profile, respectively.

According to a further embodiment, the C-shaped profile has a C-shaped section and an opening between the free ends of the C-shaped section. Preferably, the roller holder engages into the opening.

In particular, the roller holder has an element (for example an axle element) which can be introduced through the opening of the C-shaped profile.

According to a further embodiment, the first roller and the second roller each have a convex running area for guidance in the support element.

In particular, the first roller and the second roller each have a running area with a convex cross-section for guidance in a concave section (indentation) of the support element. For example, the first roller has a convex running area for guidance in a concave section (indentation) of the lower running area of the support element, and the second roller has a convex running area for guidance in a concave section (indentation) of the upper running area of the support element.

Here, a roller with a convex running area is in particular a roller with a peripheral area which does not have a groove or notch or other kind of concave area for guidance. This can also be described as follows: in a sectional plane through the roller, in which the axis of rotation thereof lies, the outer surface thereof can be depicted as a line. The curvature (second derivation) of said line preferably does not change its positive/negative sign in the region of the running area of the roller.

According to a further embodiment, the first roller and the second roller each have a running area with two radii for guidance in the support element.

In a sectional plane through the roller, in which the axis of rotation thereof lies, the center points of the radii (i.e. the center points of the corresponding circles) preferably lie in the region of the sectional area and not outside thereof.

According to a further embodiment, a third roller is rotatably mounted on the roller holder and is spaced apart upward from the lower running area and runs along the upper running area.

The third roller thus runs along the upper running area (or rolls over it), but is not in contact with the lower running area moving in the opposite direction to the third roller. Consequently, the support element is guided on its upper running area by means of the second roller and the third roller, and it is additionally guided on its lower running area by means of the first roller.

Due to the arrangement of a third roller, the support element can be more effectively guided. As a result, a tilting of the support element about an axis perpendicular to the extraction and height direction can be more effectively prevented. Moreover, the support element can be mounted in a more stable and flexurally stable manner.

According to a further embodiment, a fourth roller is rotatably mounted on the roller holder and is spaced apart downward from the upper running area and runs along the lower running area.

This fourth roller runs along the lower running area (or rolls over it), but is not in contact with the upper running area moving in the opposite direction to the fourth roller. In this embodiment in particular, the support element is guided on its upper running area by means of the second roller and the third roller, and it is additionally guided on its lower running area by means of the first roller and the fourth roller. As a result, the support element can be even more effectively guided.

In this embodiment, the four rollers may for example be arranged such that a roller guided on the upper running area and a roller guided on the lower running area form a roller pair in each case. For example, the spacing between the two rollers within a roller pair along the extraction direction of the support element in each case may be smaller than the spacing between the two roller pairs. As a result, in each roller pair, the guidance of the upper running area takes place adjacently to the guidance of the lower running area. This improves the guidance of the support element further still, prevents a twisting of the support element even more effectively and improves the mechanical stability of the mounting.

The concepts "first" roller, "second" roller, "third" roller and "fourth" roller are interchangeable. For example, in addition to the first roller and the second roller, the aforementioned fourth roller may be arranged instead of the aforementioned third roller (with the fourth roller to be referred to as third roller in this case). In this case, the support element is guided on its upper running area by means of the second roller, and it is guided on its lower running area by means of the first roller and the third roller (referred to as the fourth roller above).

According to a further embodiment, the first roller, the second roller, the third roller and the fourth roller are arranged on one of the corners of a trapezoid in each case.

As a result, the spacing between two diagonally arranged and simultaneously loaded rollers can be enlarged, while simultaneously enlarging the extraction path of the support element or maintaining a relatively large extraction path of the support element. As a result, the mechanical stability can be improved and greater loads of the extraction apparatus can be enabled while simultaneously providing a large extraction path of the support element.

According to a further embodiment, the first roller, the second roller, the third roller and the fourth roller are arranged on one of the corners of a parallelogram in each case.

The advantages described in reference to the trapezoid apply here accordingly.

According to a further embodiment, the roller holder is fastened directly to the dishwasher cavity.

In particular, the roller holder is permanently connected to a side wall of the dishwasher cavity. For example, the roller holder may be screwed, riveted or welded to the side wall.

According to a further embodiment, the roller holder is fastened to the dishwasher cavity by means of welding.

According to a further embodiment, the first roller, the second roller, the third roller and the fourth roller have the same diameter.

Preferably, the first roller, the second roller, the third roller and the fourth roller have approximately the same diameter. For example, the first roller, the second roller, the third roller and the fourth roller each have a diameter of 27 mm+/−4 mm (tolerance). The second roller, the third roller and the fourth roller, however, may also have other diameters.

Further possible implementations of the invention also comprise combinations—not explicitly cited—of features or forms of embodiment described above or below in respect of the exemplary embodiments. In this context, the person skilled in the art will also add individual aspects as improvements or enhancements to the respective basic form of the invention.

Further advantageous embodiments and aspects of the invention form the subject matter of the subclaims and of the exemplary embodiments of the invention that are described below. The invention is described below in greater detail on the basis of preferred embodiments with reference to the attached figures,

BRIEF DESCRIPTION OF THE DRAWINGS in which.

DETAILED DESCRIPTION OF EXEMPLARY EMBODIMENTS OF THE PRESENT INVENTION

Figure 1:
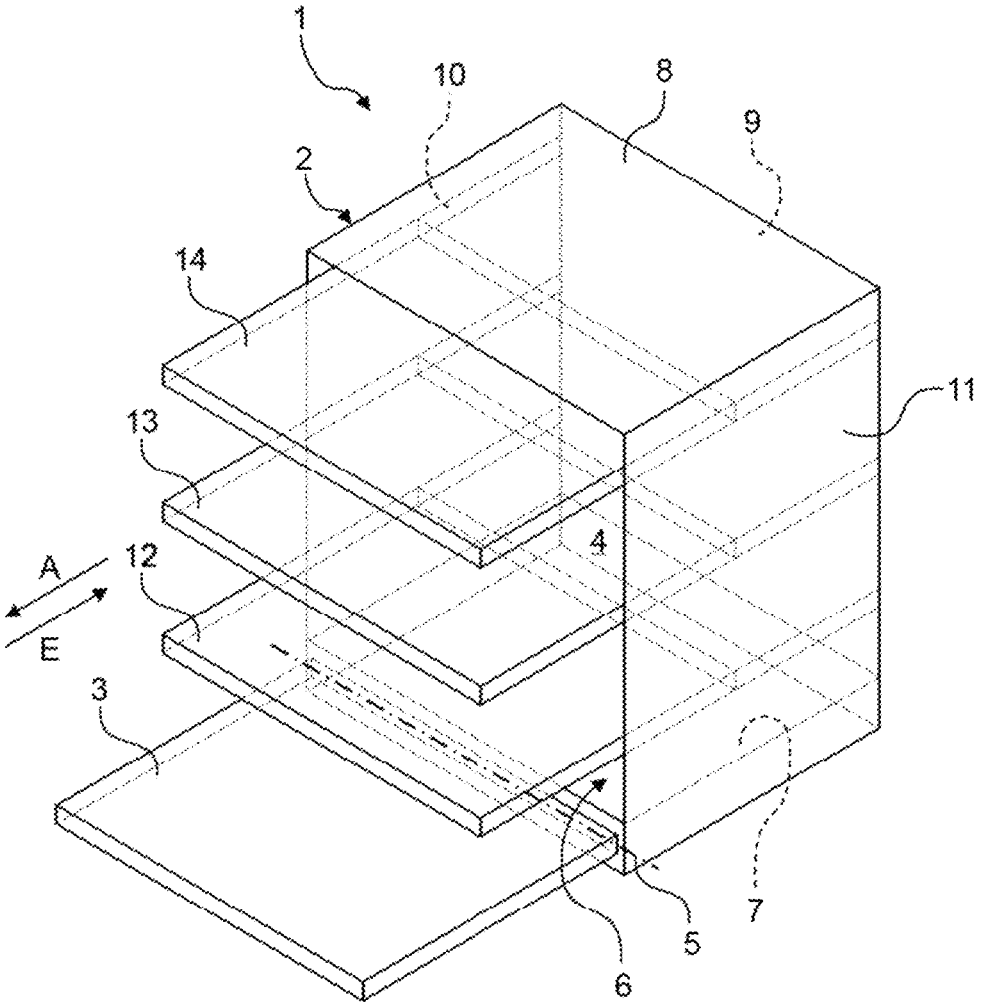
FIG. 1 shows a perspective view of a further general embodiment of a household dishwasher.

In the figures, elements that are identical or have the same function are provided with the same reference characters unless otherwise stated.

FIG. 1 shows a schematic perspective view of a general embodiment of a household dishwasher 1. The household dishwasher 1 comprises a dishwasher cavity 2, which can be closed off by a door 3, in particular in a watertight manner. To this end, a sealing facility may be provided between the door 3 and the dishwasher cavity 2. The dishwasher cavity 2 is preferably cuboid in shape. The dishwasher cavity 2 may be arranged in a housing of the household dishwasher 1. The dishwasher cavity 2 and the door 3 may form a dishwasher interior 4 for washing items to be washed.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a bottom 7, a ceiling 8 arranged opposite the bottom 7, a rear wall 9 arranged opposite the closed door 3 and two side walls 10, 11 arranged opposite one another. The bottom 7, the ceiling 8, the rear wall 9 and the side walls 10, 11 may be manufactured from a stainless steel sheet for example. Alternatively, the bottom 7 may be manufactured from a plastic material.

Furthermore, the household dishwasher 1 has at least one receptacle for items to be washed 12, 13, 14. Preferably, a plurality of receptacles for items to be washed 12, 13, 14, for example three, are provided, wherein the receptacle for items to be washed 12 may be a lower receptacle for items to be washed or a lower basket, the receptacle for items to be washed 13 may be an upper receptacle for items to be washed or an upper basket, and the receptacle for items to be washed 14 may be a cutlery drawer. As additionally shown in FIG. 1, the receptacles for items to be washed 12, 13, 14 are arranged above one another in the dishwasher cavity 2. Each receptacle for items to be washed 12, 13 14 is optionally able to be shifted into or out from the dishwasher cavity 2. In particular, each receptacle for items to be washed 12, 13, 14 can be inserted or moved into the dishwasher cavity 2 in an insertion direction E (arrow) and extracted or moved out from the dishwasher cavity 2 against the insertion direction E (arrow) in an extraction direction A (arrow).

Below, a first embodiment of the invention is described with reference to FIGS. 2 to 5, 9 and 10.

Figure 2:
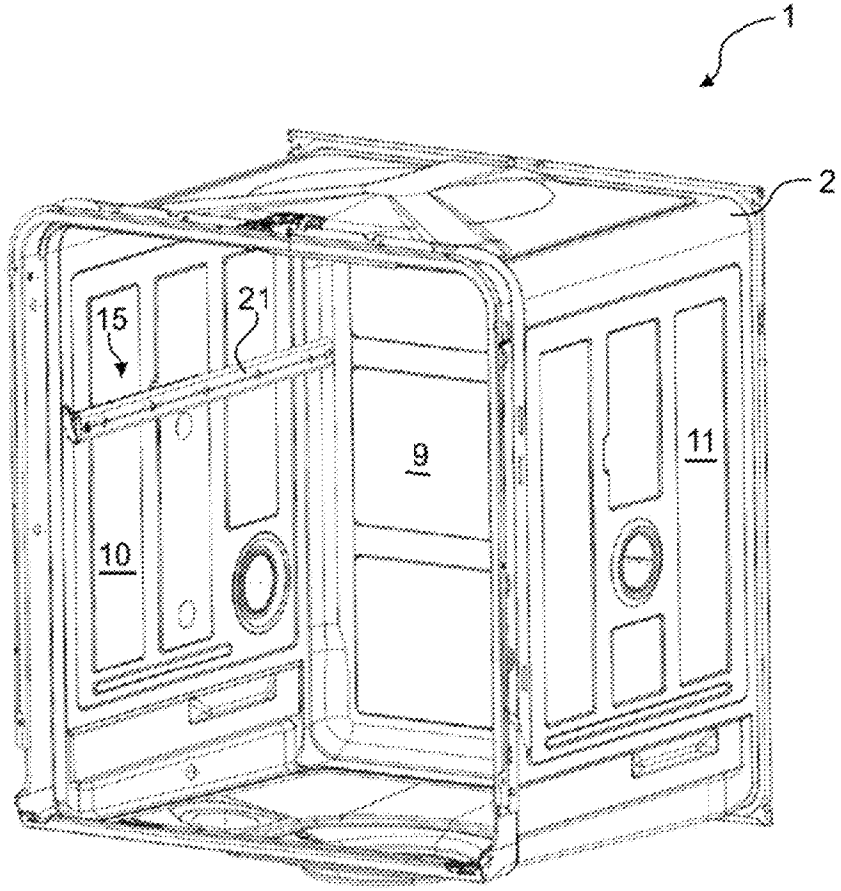
FIG. 2 shows a perspective view of a dishwasher cavity of a household dishwasher according to a first embodiment.

FIG. 2 shows a perspective view of the dishwasher cavity 2 of the household dishwasher 1. As shown in FIG. 2, the household dishwasher 1 has an extraction apparatus 15 for extracting or inserting (one of) the receptacle(s) for items to be washed 12, 13, 14. The extraction apparatus 15 is attached to the inner side of one of the side walls 10, 11 of the dishwasher cavity 2. In the example of FIG. 2, the extraction apparatus 15 is attached to the inner side of the left side wall 10 of the dishwasher cavity 2. The household dishwasher 1 may have a further extraction apparatus opposite the extraction apparatus 15, which is attached to the inner side of the right side wall 11. The extraction apparatus 15 and the extraction apparatus opposite it together serve to extract or insert a receptacle for items to be washed 12, 13, 14. The household dishwasher 1 may additionally have further extraction apparatuses similar to the extraction apparatus 15, which are attached to the inner side of the side wall 10 and/or to the inner side of the side wall 11. The further extraction apparatuses may serve to extract or insert further receptacles for items to be washed 12, 13, 14.

Figure 3:
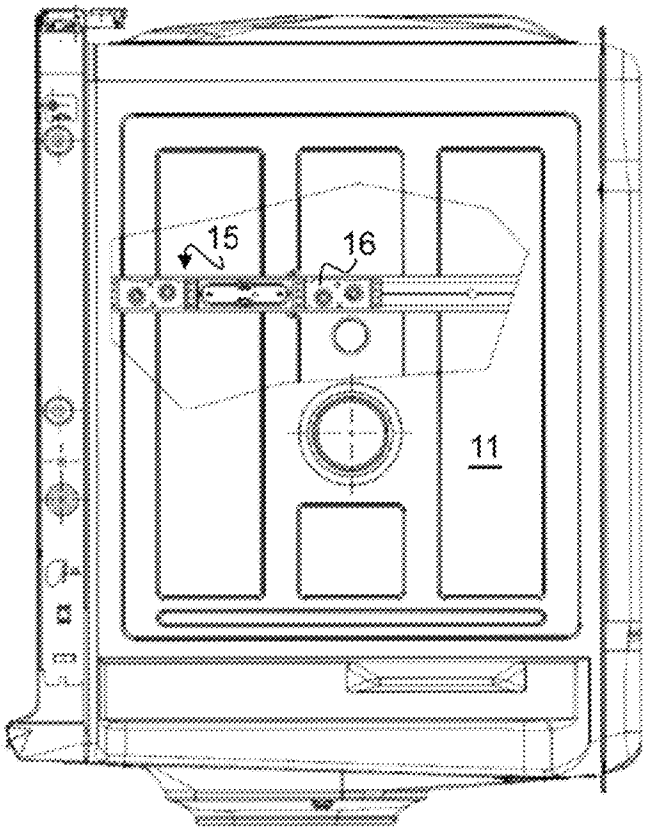
FIG. 3 shows a top view of the right side wall of the dishwasher cavity from FIG. 2, wherein the side wall is transparent in the region of a roller holder, which is fastened to the inner side of the side wall.
Figure 4:
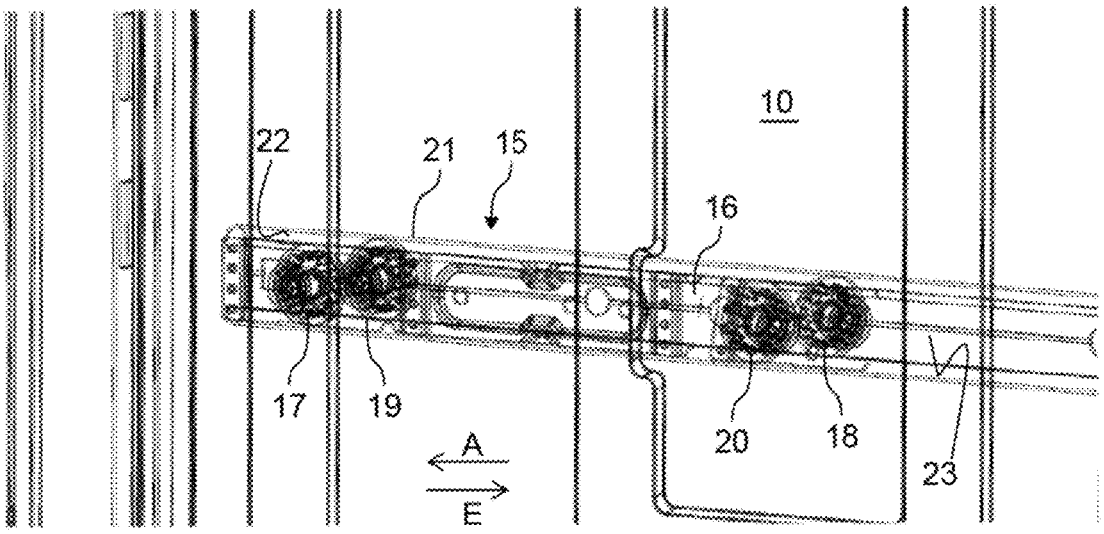
FIG. 4 shows a view of the roller holder of the first embodiment, here fastened to the inner side of the left side wall of the dishwasher cavity, together with a support element mounted such that it can move on the roller holder by means of rollers.

As shown in FIGS. 3 and 4, the extraction apparatus 15 of the first embodiment has a roller holder 16, rollers 17, 18, 19, 20 and a support element 21.

The roller holder 16 is fastened to the dishwasher cavity 2. In particular, the roller holder 16 is fastened to one of the side walls 10, 11 of the dishwasher cavity 2. The roller holder 16 may, for example, be screwed, riveted or welded to the side walls 10, 11.

FIG. 3 shows the roller holder 16 fastened to the right side wall 11 of the dishwasher cavity 2. In this context, FIG. 3 shows a top view of the outer side of the right side wall 11 of the dishwasher cavity 2 in the first embodiment, wherein the side wall 11 is transparent in the region of the roller holder 16, which is fastened to the inner side of the side wall 11.

FIG. 4 shows a view of the roller holder 16, here fastened to the inner side of the left side wall 10 of the dishwasher cavity 2, together with a support element 21 mounted such that it can move on the roller holder 16 by means of rollers 17, 18, 19, 20.

The rollers 17, 18, 19, 20 are rotatably mounted on the roller holder 16. They are preferably arranged paraxially in relation to one another with regard to their respective axes of rotation. The rollers 17, 18, 19, 20 serve to mount the support element 21 such that it can move relative to the roller holder 16.

The support element 21 serves to support the receptacle for items to be washed 12, 13, 14. The support element 21 is mounted such that it can move relative to the roller holder 16 with the aid of the rollers 17, 18, 19, 20 in such a way that the corresponding receptacle for items to be washed 12, 13, 14 can be moved between a position inserted into the dishwasher cavity 2 and a position extracted from the dishwasher cavity 2. The support element 21 can be extracted from the dishwasher interior 4 of the dishwasher cavity 2 in the extraction direction A (arrow) and inserted into the dishwasher interior 4 of the dishwasher cavity 2 in the insertion direction E (arrow).

The support element 21 may be a C-shaped rail (or "C-rail") for example, i.e. a rail with a cross-section with a C-shaped profile. The support element 21 has an upper running area 22 and a lower running area 23. Preferably, the upper running area 22 and the lower running area 23 each have a concave section for guidance of the rollers 17, 18, 19, 20.

Figure 5:
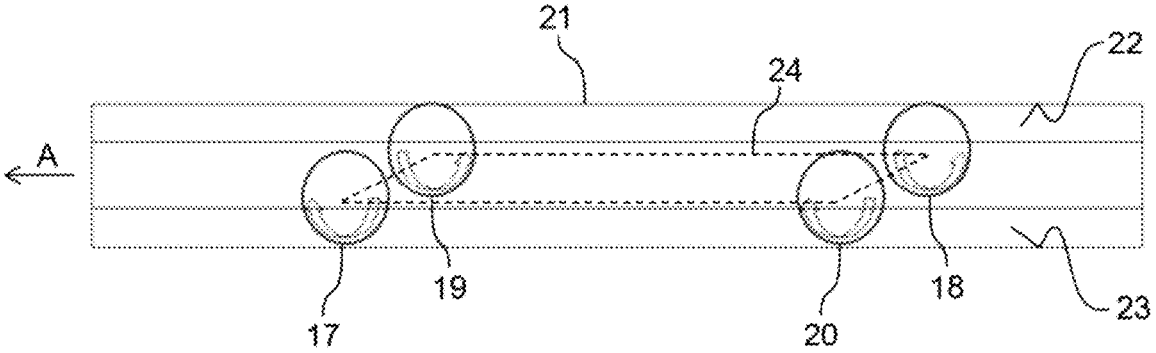
FIG. 5 shows a rolling movement of the rollers in the first embodiment.

The first roller 17 and the fourth roller 20—as can be seen in FIG. 4 and FIG. 5—are spaced apart downward from the upper running area 22 of the support element 21 and run along the lower running area 23 in each case. The second roller 18 and the third roller 19 are each spaced apart upward from the lower running area 23 and run along the upper running area 22. In the first embodiment, the first roller 17, the second roller 18, the third roller 19 and the fourth roller 20 are arranged on one of the corners of a (notional) parallelogram in each case.

The support element 21 is guided on its upper running area 22 by means of the second roller 18 and the third roller 19. In addition, the support element 21 is guided on its lower running area 23 by means of the first roller 17 and the fourth roller 20. In this context, the direction of movement of the respective running area 22, 23 and the rolling movement of the respective roller 17, 18, 19, 20 are aligned in each case, as shown in FIG. 5 by way of example for the case of the movement of the support element 21 in the extraction direction A (arrow). The direction of rotation of the rollers 17, 18, 19, 20 is marked with arrows. As a result, the support element can be effectively guided. In particular, a twisting of the support element 21 is prevented and a direct contact between parts of the rollers 17, 18, 19, 20 and running areas 22, 23 of the support element 21 which move in opposite directions is avoided.

FIG. 5 illustrates a rolling movement of the rollers 17, 18, 19, 20 in the first embodiment. In the example of FIG. 5, the support element 21 is moved in the extraction direction A (arrow). Consequently, the upper running area 22 and the lower running area 23 of the support element 21 move in the extraction direction A (arrow). As shown in FIG. 5, the rolling movements of the first roller 17 and the fourth roller 20, which both roll over the lower running area 23, are aligned with the direction of movement of the lower running area 23. Moreover, the rolling movements of the first roller 17 and the fourth roller 20 are in the opposite direction to the direction of movement of the upper running area 22, from which they are spaced apart. As shown in FIG. 5, the rolling movements of the second roller 18 and the third roller 19, which both roll over the upper running area 22, are aligned with the direction of movement of the upper running area 22. Moreover, the rolling movements of the second roller 18 and the third roller 19 are in the opposite direction to the direction of movement of the lower running area 23, from which they are spaced apart.

Figure 9:
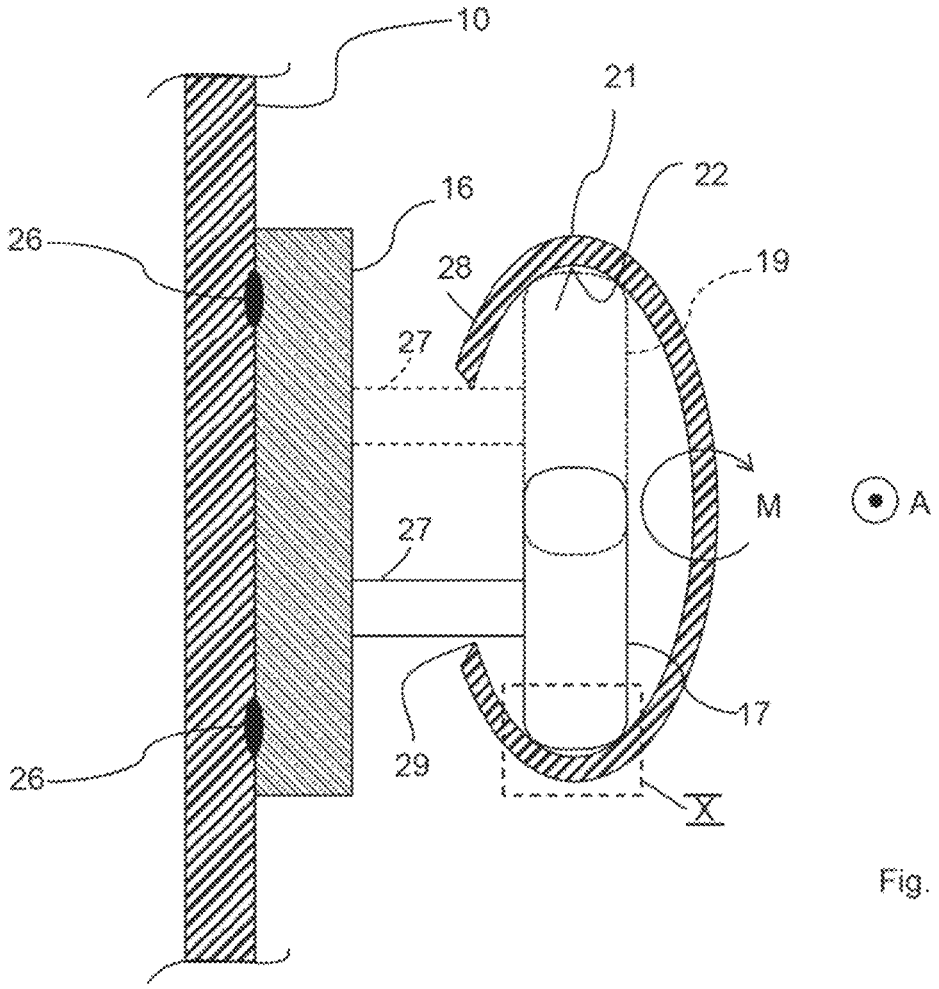
FIG. 9 shows a cross-sectional view of support element and rollers.
Figure 10:
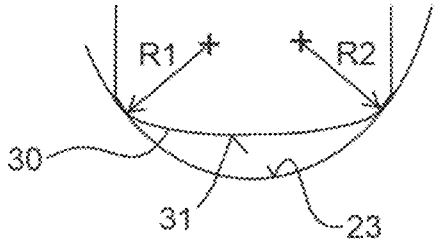
FIG. 10 shows an enlarged cut-out X from FIG. 9.

FIG. 9 and FIG. 10 clarify the relative arrangement of the support element 21 and the rollers 17, 18, 19, 20. In FIG. 9, a cross-section of the support element 21 and the roller 17 is shown. Moreover, the further roller 19 arranged to the rear is also indicated in FIG. 9. FIG. 10 shows the cut-out X from FIG. 9 in an enlarged view.

As shown in FIG. 9, the roller holder 16 is fastened to one of the side walls 10, 11, here the side wall 10. For example, the roller holder 16 is welded to the side wall 10 at welding spots 26. The roller holder 16 may further have axle elements 27 for the mounting of the rollers 17, 18, 19, 20. In the example of FIG. 9, the support element 21 has a C-shaped profile, and it may be embodied in one piece for example. The C-shaped profile has a C-shaped section 28 and an opening 29 between the free ends of the C-shaped section. In this example, the roller holder 16 engages into the opening 29 of the C-shaped profile. To this end, the roller holder 16 has an element (for example the axle element 27) which can be introduced by means of the opening 29 of the C-shaped profile.

As shown in FIG. 9 and FIG. 10, the rollers 17 and 19 run in a cavity formed by the support element 21. The roller 17 runs on the lower running area 23 of the support element 21. The roller 19 arranged further to the rear and shifted upward runs on the upper running area 22 of the support element 21. The roller 17 and the roller 19 each have a convex running area 30 for guidance in the support element 21. The convex running area 30 has an outer surface, which is represented as a curved line in its cross-section. As shown in FIG. 10 for the roller 17, this outer surface preferably has two radii R1 and R2 for guidance in a concave section (indentation) of the running area 23 of the support element 21. A section 31 of the running area 30 of the roller 17 which lies between the radii R1, R2 is spaced apart from the lower running area 23. The same applies for the roller 19 and the upper running area 22, accordingly.

During operation of the household dishwasher, the support element 21 supports a receptacle for items to be washed 12, 13, 14. A torque M can be exerted upon the support element 21 by (heavy) items to be washed in the receptacle for items to be washed 12, 13, 14 and/or extracting the support element 21 at an angle. This may lead to a twisting of the support element 21 in relation to its longitudinal axis, which is parallel to the extraction direction A (arrow).

In the embodiment described, the support element 21 is guided on the rollers 17, 18, 19, 20 in such a way that, despite such a twisting of the support element 21, only areas moved in the same direction may come into contact with one another. Consequently, scratching and grinding noises on the support element 21 and a blocking of the rollers are avoided. A defined rolling-over movement of the rollers 17, 18, 19, 20 is ensured. The support element 21 may be guided in a stable manner, with low noise and with little exertion of force on the rollers 17, 18, 19, 20.

A second embodiment is described below on the basis of FIG. 6, FIG. 7 and FIG. 8.

The second embodiment is similar to the first embodiment, except for the arrangement of the four rollers 17, 18, 19, 20. In the second embodiment, the first roller 17, the second roller 18, the third roller 19 and the fourth roller 20 are arranged in the shape of a trapezoid. Only the features of the second embodiment which differ from those of the first embodiment are described below. A description of identical features is dispensed with.

Figure 6:
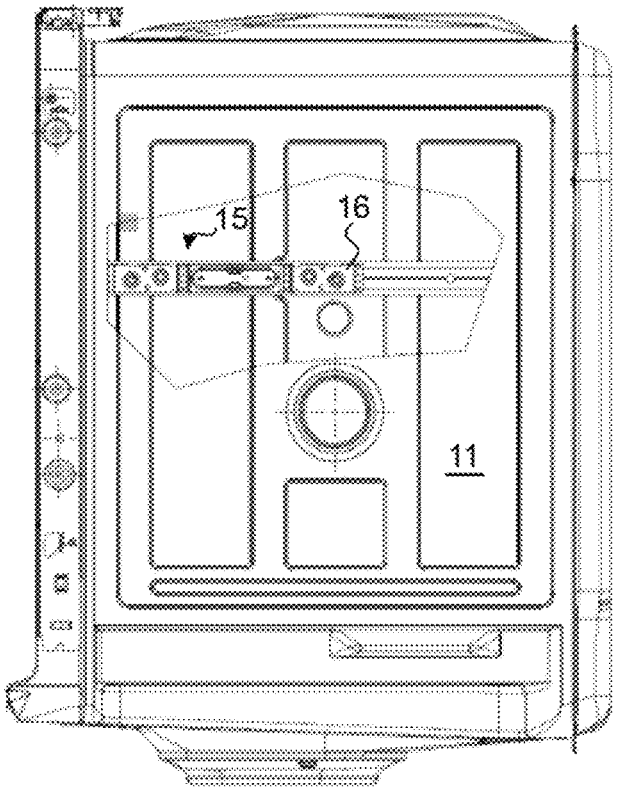
FIG. 6 shows a top view of the right side wall of the dishwasher cavity from FIG. 2, (but) according to a second embodiment, wherein the side wall is transparent in the region of a roller holder, which is fastened to the inner side of the side wall.

FIG. 6 shows a top view of the right side wall 11 of the dishwasher cavity 2 according to the second embodiment, wherein the side wall 11 is transparent in the region of the roller holder 16, which is fastened to the inner side of the side wall 11.

Figure 7:
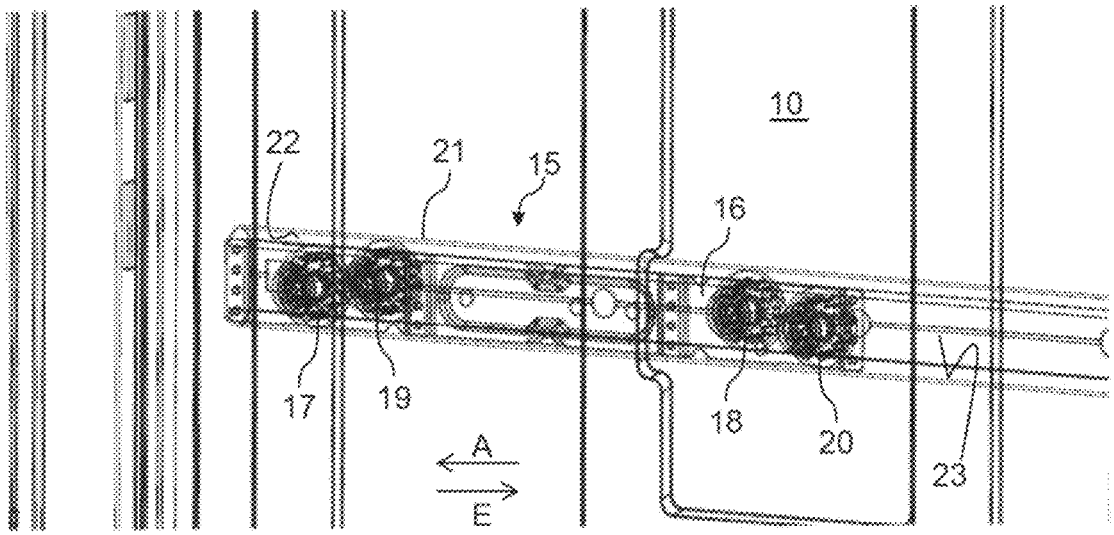
FIG. 7 shows a view of the roller holder of the second embodiment, here fastened to the inner side of the left side wall of the dishwasher cavity, together with a support element mounted such that it can move on the roller holder by means of rollers.
Figure 8:
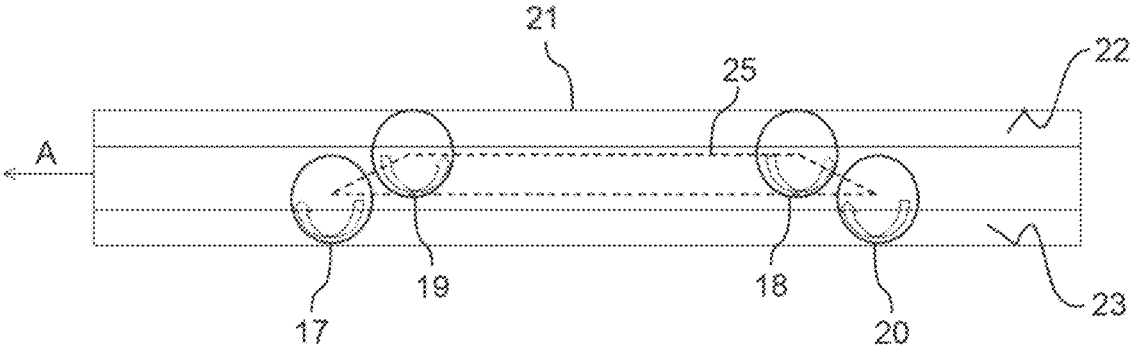
FIG. 8 shows a rolling movement of the rollers in the second embodiment.

FIG. 7 shows a view of the roller holder 16 of the second embodiment, here fastened to the inner side of the left side wall 10 of the dishwasher cavity 2, together with the support element 21 mounted such that it can move on the roller holder 16 by means of rollers 17, 18, 19, 20.

As shown in FIG. 7, in the second embodiment the first roller 17 and the fourth roller 20 are spaced apart downward from the upper running area 22 of the support element 21 and run along the lower running area 23 in each case. The second roller 18 and the third roller 19 are each spaced apart upward from the lower running area 23 and run along the upper running area 22. As shown in FIG. 7 and FIG. 8, in the second embodiment, the first roller 17, the second roller 18, the third roller 19 and the fourth roller 20 are arranged on one of the corners of a (notional) trapezoid 25 in each case.

Although the present invention has been described on the basis of exemplary embodiments, it can be modified in a variety of ways.

The invention claimed is:

1. A household dishwasher, comprising:

a dishwasher cavity;

a first roller;

a second roller;

a roller holder fastened to the dishwasher cavity and configured to mount the first roller and the second roller for rotation, the roller holder having stationary axle elements which are fixed to the roller holder, the first roller and the second roller being respectively rotatably supported on the stationary axle elements; and a support element for supporting a receptacle for items to be washed, said support element movably mounted relative to the roller holder with the aid of the first roller and the second roller in such a way that the receptacle is movable between a position in which the receptacle is inserted into the dishwasher cavity and a position in which the receptacle is extracted from the dishwasher cavity, said support element having a C-shaped profile defining an upper running area and a lower running area, with the first roller being spaced apart downward from the upper running area and running along the lower running area, and with the second roller being spaced apart upward from the lower running area and running along the upper running area, wherein the stationary axle elements extend from the roller holder into an interior of the C-shaped profile of the support element to provide a stationary cylindrical surface for the first roller and the second roller, respectively, to rotate on.

2. The household dishwasher of claim 1, wherein the support element is embodied in one piece.

3. The household dishwasher of claim 1, wherein the support element is made from metal.

4. The household dishwasher of claim 1, wherein the C-shaped profile includes a C-shaped section defining free ends and having an opening between the free ends of the C-shaped section, with the stationary axle elements the roller holder extending through the opening.

5. The household dishwasher of claim 1, wherein the first roller and the second roller each have a convex running area for guidance in the support element.

6. The household dishwasher of claim 1, wherein the first roller and the second roller each have a running area with two radii for guidance in the support element.

7. The household dishwasher of claim 1, further comprising a third roller rotatably mounted on the roller holder, said third roller being spaced apart upward from the lower running area and running along the upper running area.

8. The household dishwasher of claim 7, further comprising a fourth roller rotatably mounted on the roller holder, said fourth roller being spaced apart downward from the upper running area and running along the lower running area.

9. The household dishwasher of claim 8, wherein the first roller, the second roller, the third roller and the fourth roller are respectively arranged on corners of a trapezoid.

10. The household dishwasher of claim 8, wherein the first roller, the second roller, the third roller and the fourth roller are respectively arranged on corners of a parallelogram.

11. The household dishwasher of claim 1, wherein the roller holder is directly fastened to the dishwasher cavity.

12. The household dishwasher of claim 1, wherein the roller holder is welded to the dishwasher cavity.

13. The household dishwasher of claim 8, wherein the first roller, the second roller, the third roller and the fourth roller have a same diameter.

14. The household dishwasher of claim 1, wherein the first roller and the second roller have circular openings that pass therethrough, that are respectively rotatably supported on the stationary axle elements, and that are located within the C-shaped profile of the support element.

* * * * *